US006742486B2

(12) United States Patent
Palesch et al.

(10) Patent No.: US 6,742,486 B2
(45) Date of Patent: Jun. 1, 2004

(54) DEVICE FOR ADJUSTING THE ROTATION ANGLE OF THE CAMSHAFT OF AN INTERNAL COMBUSTION ENGINE IN RELATION TO A DRIVE WHEEL

(75) Inventors: Edwin Palesch, Lenningen (DE); Martin Maier, Hechingen (DE); Gordon Rein, Ulm (DE)

(73) Assignees: Dr. Ing. h.c.F. Porsche AG, Stuttgart (DE); Hydraulik Ring GmbH, Neurtingen (DE)

( * ) Notice: Subject to any disclaimer, the term of this patent is extended or adjusted under 35 U.S.C. 154(b) by 0 days.

(21) Appl. No.: 10/169,672

(22) PCT Filed: Feb. 15, 2002

(86) PCT No.: PCT/EP01/12262

§ 371 (c)(1),
(2), (4) Date: Dec. 10, 2002

(87) PCT Pub. No.: WO02/42613

PCT Pub. Date: May 30, 1992

(65) Prior Publication Data

US 2003/0154944 A1 Aug. 21, 2003

(51) Int. Cl.[7] ..... F01L 1/34

(52) U.S. Cl. ..... 123/90.17; 123/90.15; 123/90.31

(58) Field of Search ..... 123/90.17, 90.12, 123/90.15, 90.31

(56) References Cited

U.S. PATENT DOCUMENTS

| | | | | |
|---|---|---|---|---|
| 4,858,572 A | | 8/1989 | Shirai et al. | 123/90.12 |
| 5,816,204 A | * | 10/1998 | Moriya et al. | 123/90.17 |
| 6,006,708 A | * | 12/1999 | Ken et al. | 123/90.17 |
| 6,477,996 B2 | * | 11/2002 | Ogawa | 123/90.15 |

FOREIGN PATENT DOCUMENTS

| | | |
|---|---|---|
| DE | 198 25 287 | 12/1998 |
| DE | 199 03 624 | 8/1999 |
| EP | 857 858 | 12/1997 |

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

A system for relative angle-of-rotation adjustment of a camshaft of an internal-combustion engine. An adjusting unit has an interior part connected with the camshaft, and a cell wheel with several cells distributed along the circumference. Interior part webs divide the cells into two pressure spaces. Hydraulic pressure admitted or relieved from the pressure spaces causes camshaft rotation between two end positions. A movable locking element in the cell wheel or the interior part opens up a hydraulic line to a pressure space when in an unlocked position. When in a locked position, bores in the interior part are closed off. The locking element can move into first and second unlocking positions, whereby the various bores are opened at desired intervals as the locking element moves. As a result, the useful life and the functionality of the locking device is improved.

4 Claims, 5 Drawing Sheets

DEVICE FOR ADJUSTING THE ROTATION ANGLE OF THE CAMSHAFT OF AN INTERNAL COMBUSTION ENGINE IN RELATION TO A DRIVE WHEEL

BACKGROUND AND SUMMARY OF THE INVENTION

The invention relates to a system for the relative angle-of-rotation adjustment of a camshaft of an internal-combustion engine with respect to a driving wheel having an adjusting unit which has an interior part non-rotatably connected with the camshaft, the adjusting unit having a cell wheel which encloses the interior part and which has several cells distributed along the circumference and bounded by webs, which cells are divided by webs or blades of the interior part angularly movably guided therein into two pressure spaces respectively, during whose hydraulic pressure admission or pressure relief, the camshaft can be rotated by way of the webs or blades between two end positions relative to the cell wheel and that a movable locking element interacts with at least one counterelement in the respective other one of the two components—cell wheel or interior part, that the locking element is arranged in a hydraulic line leading to a pressure space and, only in an unlocked position, opens up the hydraulic line to the pressure space, and that bores leading to the pressure spaces are arranged in the interior part, the openings of the bores in the locked end position of the adjusting unit being closed off by the webs of the cell wheel.

From German Patent Document DE 196 23 818 A1, a system of the above-mentioned type is known in which the camshaft adjuster can be locked in an end position by means of a locking element arranged in the rotor of the camshaft adjuster. By way of hydraulic lines leading to the locking element, the locking element can be changed from its locking position into an unlocked position. When the camshaft adjuster is unlocked, as a result of the hydraulic adjustment of the rotor relative to the driving wheel of the camshaft, the timing of the inlet and outlet valves respectively can be changed as desired. The system illustrated in German Patent Document DE 196 23 818 A1 is constructed such that the pressure admission to the hydraulic chambers, by means of which the adjustment of the rotor with respect to the stator of the camshaft adjuster takes place, and the hydraulic pressure admission for unlocking the locking pin takes place in parallel. However, this does not always ensure that the locking of the adjusting unit is released first before the rotor is changed into an adjusting position by the pressure chambers or hydraulic chambers constructed in the adjusting unit. As a result, operating conditions may occur in which the adjusting unit does not operate in a reliable manner.

German Patent Document DE 198 25 287 A1 shows a camshaft adjuster in the case of which the pressure oil feeding to the working chambers is controlled by way of the locking element provided in the camshaft adjuster. As a result of the change of the locking element to the unlocked position, the locking element opens up a pressure duct and the working chambers constructed in the camshaft adjuster are isochronously acted upon by pressure oil by way of ducts leading to the chambers.

It is therefore an object of the invention to improve a system of the above-mentioned type such that starting noises during the activation of the camshaft adjuster are prevented or reduced and the useful life or the functionality of the locking unit is increased.

According to the invention, this object is achieved by providing a system having an adjusting unit which has an interior part non-rotatably connected with the camshaft, the adjusting unit having a cell wheel which encloses the interior part and which has several cells distributed along the circumference and bounded by webs, which cells are divided by webs or blades of the interior part angularly movably guided therein into two pressure spaces respectively, during whose hydraulic pressure admission or pressure relief, the camshaft can be rotated by way of the webs or blades between two end positions relative to the cell wheel and that a movable locking element interacts with at least one counterelement in the respective other one of the two components—cell wheel or interior part, that the locking element is arranged in a hydraulic line leading to a pressure space and, only in an unlocked position, opens up the hydraulic line to the pressure space, and that bores leading to the pressure spaces are arranged in the interior part, the openings of the bores in the locked end position of the adjusting unit being closed off by the webs of the cell wheel, characterized in that the locking element can be changed into a first unlocking position, in which the bore in the web controlled by the locking element as well as the bores in the interior part leading to the pressure spaces are still closed, and in that the locking element can be changed into a second unlocking position in which first the bore leading to the pressure space is opened up by the-locking element and, after an initial adjusting path ($\alpha$) of the interior part, also the bores leading to the pressure spaces are opened up.

In contrast to the locking unit of a camshaft adjuster illustrated in German Patent Document DE 198 25 287 A1, the locking element is advantageously by means of a first adjusting lift first changed into an unlocked position in which, however, the hydraulic duct controlled by the locking element as well as the oil feeding bores leading to the other pressure spaces are still closed. However, when the locking element is lifted beyond its unlocked position, the hydraulic duct leading to the pressure space of the adjusting unit is opened up before, after a short initial adjusting path of the rotor of the adjusting unit, the oil feeding bores leading to the remaining pressure spaces are also opened up and the rotor can be further adjusted in a desirable manner with respect to the stator of the adjusting unit. As a result of this type of pressure admission, a starting rattle of the camshaft adjuster is prevented or reduced. Furthermore, the bearing of the locking element in the locking bore can be reduced. This considerably improves the useful life and the functionality of the locking device.

Additional advantages and advantageous further developments of the invention are contained in the subclaims and the description.

The locking element is received in a bore which is arranged in a web or a blade of the rotor. The bore is arranged in a hydraulic-oil feed line which leads to a pressure space arranged in the adjusting unit. When the locking element is in a locked position, the hydraulic line is closed by the locking element. In an unlocked position, the locking element opens up the hydraulic line to the pressure space.

BRIEF DESCRIPTION OF THE DRAWINGS

An embodiment of the invention is explained in detail in the following description and drawing.

DETAILED DESCRITPION OF THE DRAWINGS

Description of the Embodiment

Figure 1A:
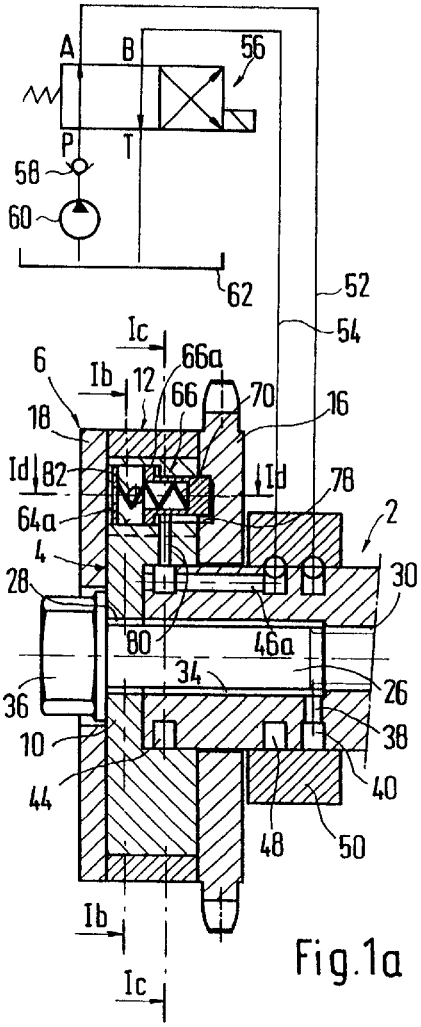
FIG. 1*a* is a longitudinal sectional view of the adjusting unit.
Figure 1D:
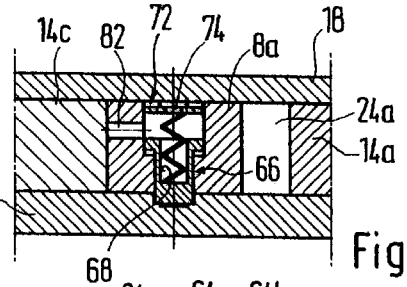
FIG. 1*d* is a sectional view along Line ID—ID in FIG. 1*a*.
Figure 1B:
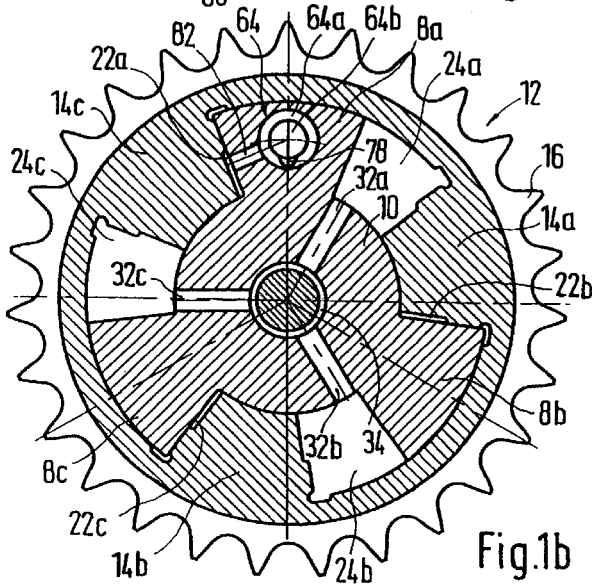
FIG. 1*b* is a sectional view along Line IB—IB in FIG. 1*a*.
Figure 1C:
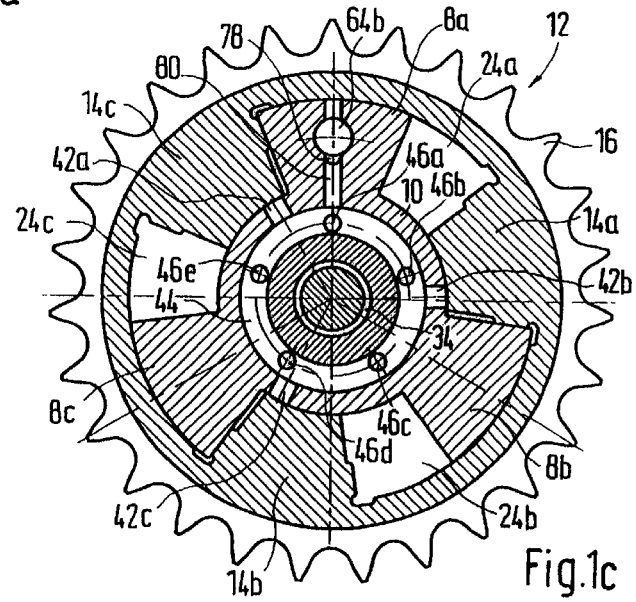
FIG. 1*c* is a sectional view along Line IC—IC in FIG. 1*a*.
Figure 2A:
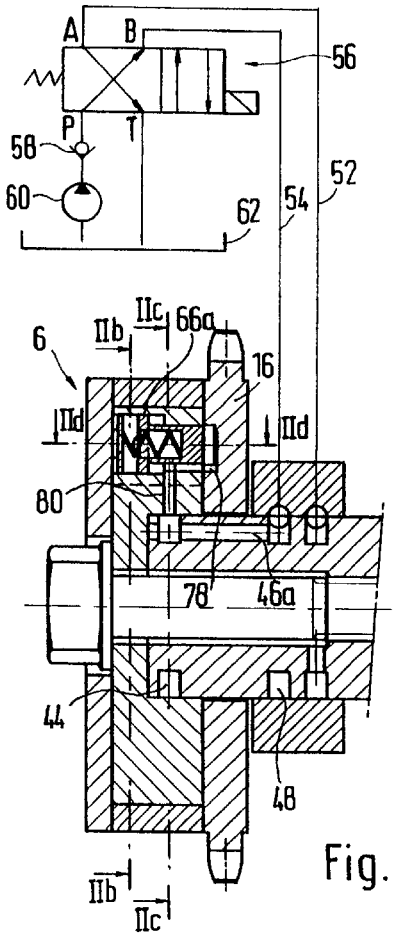
FIGS. 2*a* to 5*c* are views of various operating conditions of the adjusting unit in the adjusting direction.
Figure 2D:
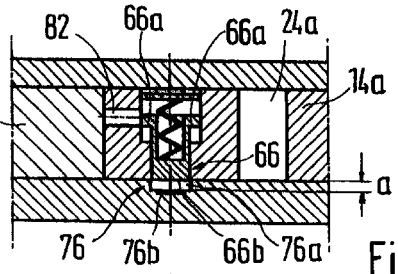
Figure 2B:
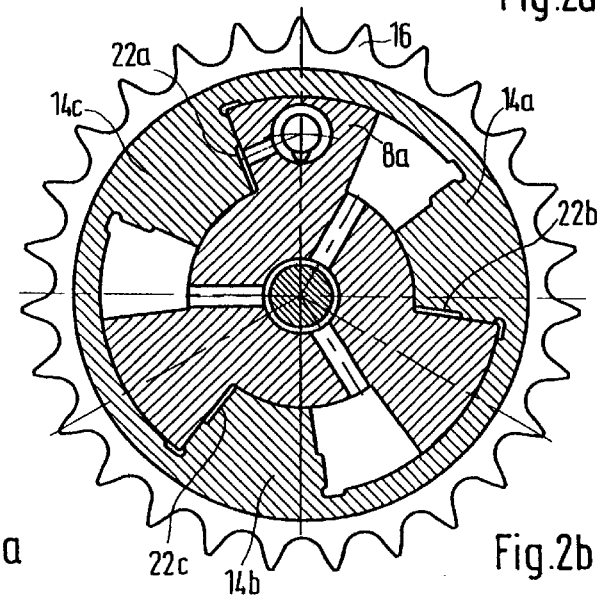
Figure 2C:
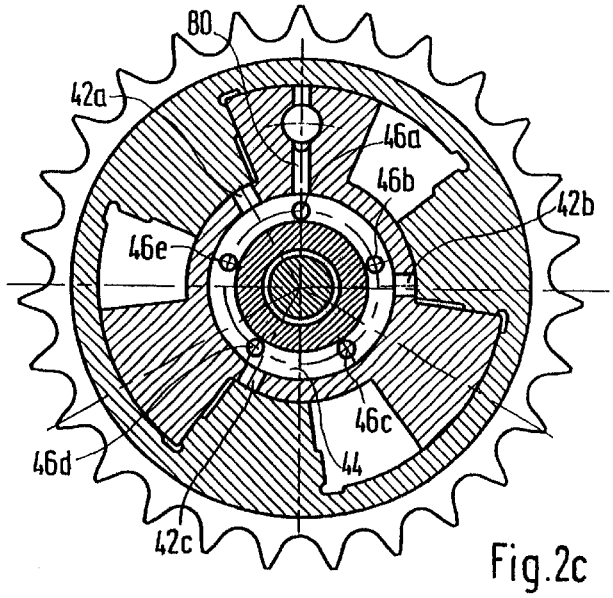
Figure 3A:
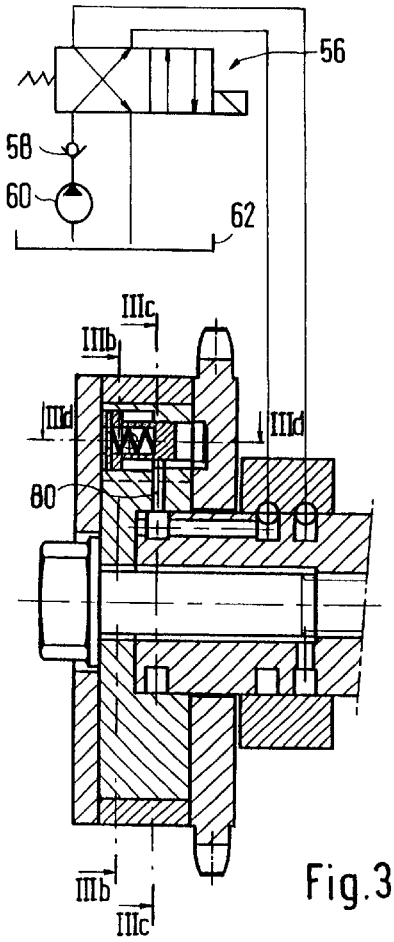
Figure 3D:
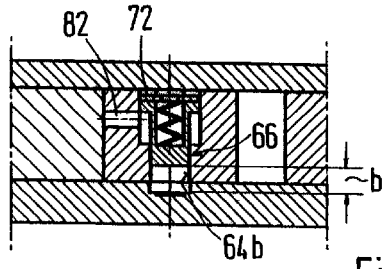
Figure 3B:
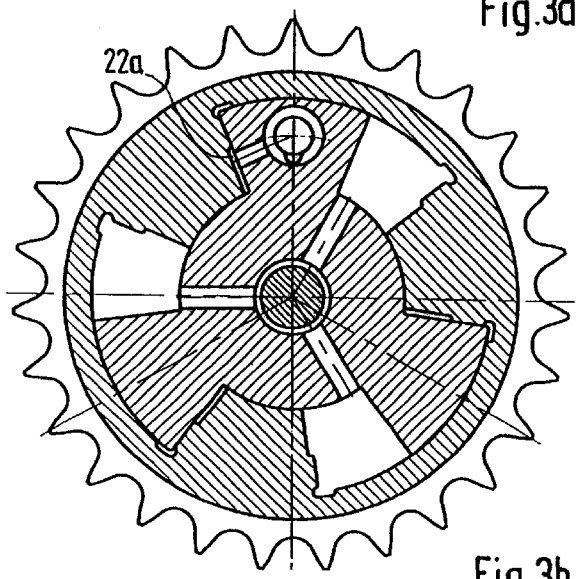
Figure 3C:
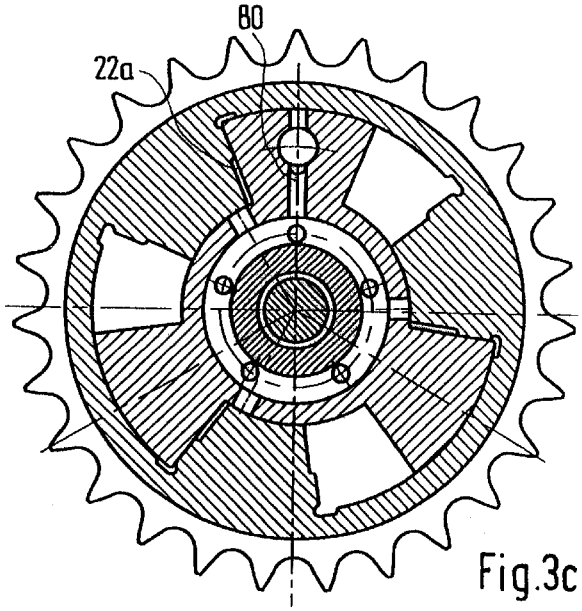

In the drawing, reference number 2 is a schematic outline of the camshaft of an internal-combustion engine, on whose free end, the rotor—in the following, called interior part 4—of an adjusting unit 6 is arranged in a nonrotatable manner. In the present embodiment, the interior part 4 is provided with three radially arranged webs 8*a* to 8*c*, which start out from a hub 10 of the interior part 4. In the area of its webs 8*a* to 8*c*, the interior part 4 is enclosed by a cell wheel 12 which is provided with three inward-projecting radial webs 14*a* to 14*c*. The cell wheel 12 representing the stator of the adjusting unit is closed off on its face facing the camshaft 2 by a sprocket wheel 16 which is rotatably and sealingly guided on the hub 10 of the interior part 4. The sprocket wheel 16 is used for the drive of the camshaft which takes place, for example, by way of a control or driving chain connected with the crankshaft. The opposite face of the cell wheel 12 is closed off by a disk 18, the sprocket wheel 16, the disk 18 and the cell wheel 12 being firmly connected with one another by means of screwing devices which are not shown. By means of the webs 14*a* to 14*c* of the cell wheel 12, three cells are constructed which are bounded in the axial direction by the sprocket wheel 16 and the disk 18 and are divided by means of the webs 8*a* to 8*c* of the interior part 4 into two pressure spaces 22*a* to 22*c* and 24*a* to 24*c* respectively. The interior part 4 and the cell wheel 12 rotatably guided on the latter are fastened by means of a screw 26 to the camshaft 2. For this purpose, the hub 10 has a central bore 28 which continues in the camshaft 2 and which is adjoined by a threaded bore 30 having a smaller diameter, in which-threaded bore 30 the screw 26 is fastened. By way of three radially extending bores 32*a* to 32*c*, which are arranged in the hub 10 of the interior part 4, the pressure spaces 24*a* to 24*c* are connected with a ring space 34 which is formed between the fastening screw 26 for the adjusting unit 6 and the wall section of the central bore 28 provided in the hub 10 and in the camshaft 2, the ring space 34 being closed off on the end side by the head 36 of the screw 26.

The ring space 34 is connected by way of several bores 38 extending radially in the camshaft 2 with a ring groove 40 arranged on the outer circumference of the camshaft 2. Three additional radially extending bores 42*a* to 42*c*, which are arranged on the outer circumference of the hub 10, are connected on the one side, as a function of the rotating position of the interior part 4 with respect to the cell wheel 12 (will be explained in detail below) with one of the three pressure spaces 22*a* to 22*c* respectively. On the other side, they are connected with a ring groove 44 arranged on the outer circumference of the camshaft 2, which ring groove 44 leads by way of five bores 46*a* to 46*e*, which extend axially in the camshaft 2, to another ring groove 48 also constructed on the outer circumference of the camshaft 2.

The two ring grooves 40 and 44 are each connected by way of a camshaft bearing 50 acting as a rotary transmission leadthrough to two control lines 52 and 54 which lead to a control valve 56 constructed as a 4/2 proportional control valve. The control line 52 is connected to the output A of the control valve 56, while the control line 54 leads to the output B of the control valve 56. On the input side, the control valve 56 has a pressure connection P, which is connected by way of a return valve 58 and a pressure medium pump 60 with an oil tank 62 and by way of a connection T, which also leads to the oil tank 62.

For the locking of the interior part 4 with respect to the cell wheel 12 in an end position of the adjusting unit 6 illustrated according to FIGS. 1 to 3, a bore 64 is provided in the web 8*a*, in which bore 64 a locking element, in the following called locking pin 66, is arranged. The bore 64 is constructed as a step bore, in which case the head part of the locking pin 66, which is provided with a ring shoulder 66*a*, is guided in the larger bore section 64*a*, while the actual locking pin 66 is guided in the smaller bore section 64*b* of the step bore 64. The locking pin 66 has an opening 68 in which a pressure spring 70 is arranged which is clamped in between the bottom of the opening 68 and a plastic disk 72 supported at the disk 18 and arranged in the bore section 64*a*. The plastic disk 72 has a central opening 74 which is connected with the oil tank 62 by way of a duct which is not shown. Thus, when the locking pin 66 is displaced against the spring force of the pressure spring 70, leakage oil can escape which is situated in the opening 68.

A step bore 76 is placed in the sprocket wheel 16, the locking pin 66 for locking the interior part 4 with respect to the sprocket wheel 16 and the cell wheel 12 respectively engaging in a first bore section 76*a*. This first bore section 76*a* is adjoined by a second bore section 76*b* which has a smaller diameter than the locking pin 66. At the outer circumference of the smaller bore section 64*b*, which is used for receiving the locking pin 66, a crescent-shaped groove 78 is arranged which extends into the step bore 76 and is therefore connected with the second bore section 76*b*.

A radial passage bore 80 is arranged in the web 8*a*, which passage bore 80 is connected on the one side with the axial bore 46*a* and with the ring groove 44 and, on the other side, leads to the groove 78. Furthermore, a bore 82 constructed as a connection duct is provided in the web 8*a*, which bore 82 leads from the larger bore section 64*a* in the radial direction to the pressure space 22*a*.

In the present embodiment, the adjusting unit 6 with its end position illustrated in FIGS. 1 to 3 is provided for the adjustment of an inlet camshaft, in which case the cell wheel 12 can be driven clockwise and the interior part 4 can be adjusted clockwise in the direction "early" opening of the inlet valves.

In the following, the adjusting operation will be described in detail by means of the figures:

In the position illustrated in FIG. 1, the internal-combustion engine is inoperative, that is, it is stopped. The locking pin 66 is in its locked position; that is, it is locked by the pressure spring 70 in the bore-section 76*a* of the sprocket wheel 16. Thus, the interior part 4 is in an end position with respect to the cell wheel 12, which end position corresponds to a "late" opening or closing time of the inlet valves of the internal-combustion engine operated by way of cams and cam followers. The control valve 56 is not energized, so that the pressure oil supply to the pressure spaces 24*a* to 24*c* is opened up for the starting operation of the internal-combustion engine by way of the output A of the control valve 56, the control line 52, the ring groove 40, the radial bores 38, the ring space 34 and the radial bores 32*a* to 24*c*.

When, after the starting operation, the internal-combustion engine has reached a certain idling rotational speed, the control valve 56 will be energized and thus the pressure oil supply is switched over to the output B (see FIG. 2). The pressure oil supply now leads by way of the control line 54, the ring groove, 48, the axial bore 46*a* to 46*e* to the ring groove 44. From the ring groove 44, the three radial bores 42*a* to 42*c*, on the one hand, and the bore 80 leading to the locking pin 66, on the other hand, are supplied with pressure oil. The pressure oil supply by way of the radial bores 42*a* to 42*c* to the three pressure spaces 22*a* to 22*c* is still blocked because, in the end position of the camshaft adjuster, the radial bores 42*a* to 42*c* are covered or sealed off by the radial webs 14*a* to 14*c* of the cell wheel (see FIG. 2*c*). In contrast, the oil duct (bore 80) leading to the locking pin 66 is open, so that, as a result of the oil pressure forming below its ring shoulder 66*a* and on its face 66*b*, it is lifted out of the bore section 76*a* arranged in the sprocket wheel 16, and the adjusting unit 6 is therefore unlocked. In this case, the pressure oil supply to the face 66*b* of the locking pin 66 takes place by way of the groove 78 leading to the bore section 76*b*.

However, during the unlocking lift a of the locking pin 66 illustrated in FIG. 2, the bore 82 arranged in the web 8*a* and leading to the pressure space 22*a* is still closed off by the shoulder 66*a*. Only when the locking pin 66 is lifted by the applied oil pressure beyond the unlocking lift a, will the opening of the bore 82 be opened up by way of the leading edge of the shoulder 66*a*. The bore 82 will be completely opened up when, as illustrated in FIG. 3, the head portion of the locking pin 66 comes to rest on the disk 72 (unlocking lift b).

Figure 4A:
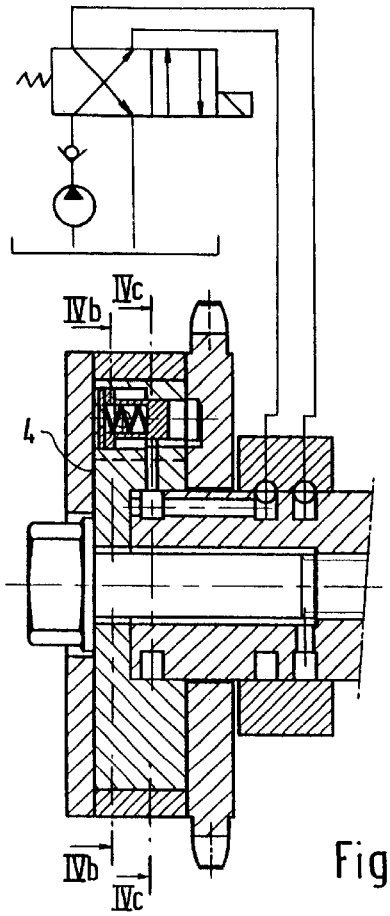
Figure 4B:
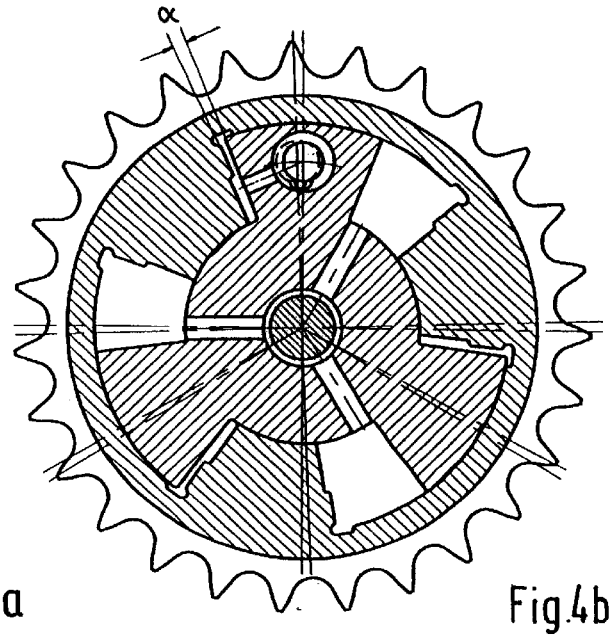
Figure 4C:
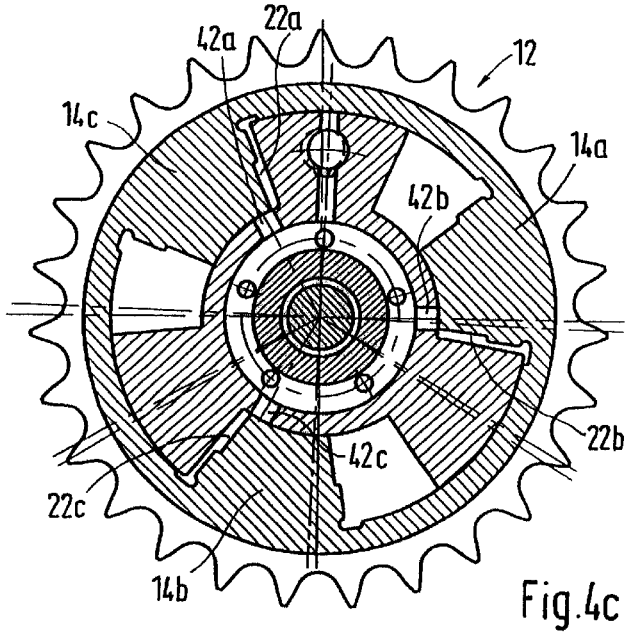

As a result, hydraulic oil arrives in the pressure space 22*a* by way of the bore 80. The system is designed such that, at a rotational adjusting speed of the internal-combustion engine, the hydraulic oil fed to the pressure space 22*a* adjusts the interior part 4 by the angle a clockwise (see FIG. 4*b*). As a result of this initial adjusting path, the radial bores 42*a* to 42*c* arranged in the interior part 4 are guided out of their complete overlapping with the radial webs 14*a* to 14*c* of the cell wheel 12, so that, by way of the radial bores 42*a* to 42*c*, the hydraulic oil arrives in the pressure spaces 22*a* to 22*c*.

Figure 5A:
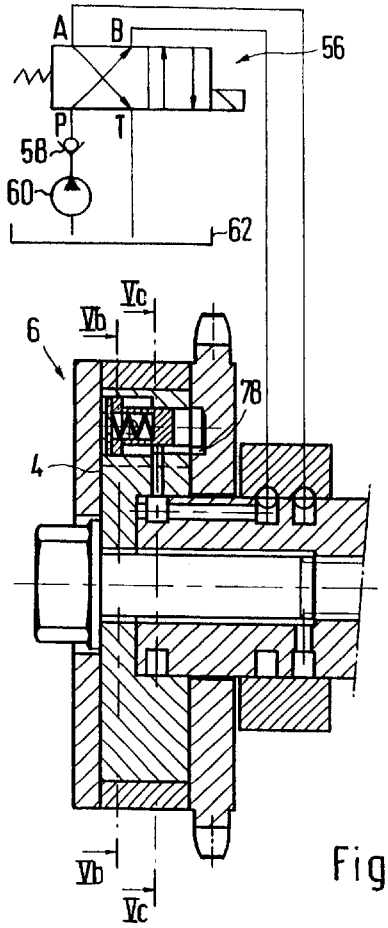
Figure 5B:
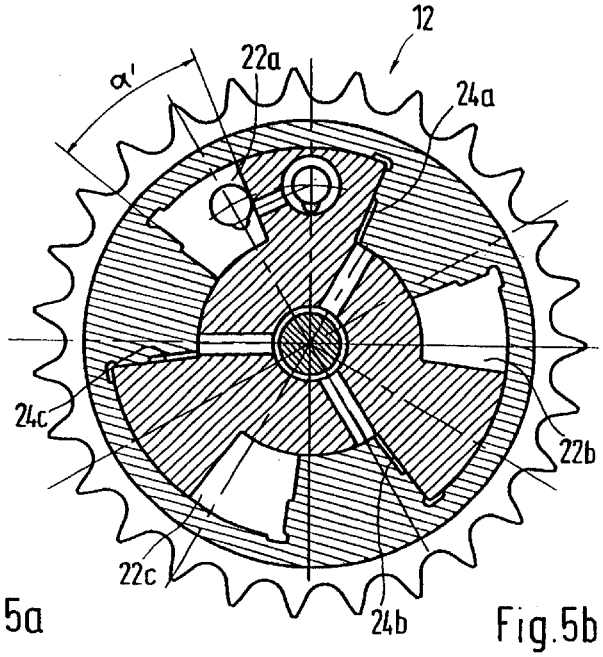
Figure 5C:
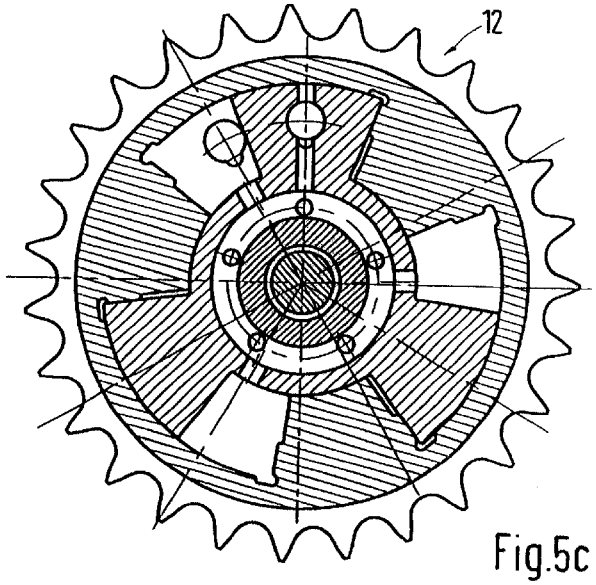

As a result, as illustrated in FIG. 5, the interior part 4 of the adjusting unit 6 can be adjusted with respect to the cell wheel 12 up to a maximal adjusting angle $\alpha'$ in the "early" opening direction of the inlet valves.

When the rotational engine speed is reduced, the control valve 56 will no longer be energized. As a result, a change-over to the output A takes place again and the pressure chambers 24*a* to 24*c* are supplied with pressure oil. The interior part 4 is thereby set back counterclockwise in the direction of its originally locked end position. The pressure oil situated in the pressure chambers 22*a* to 22*c* is returned by way of the output B of the control valve 56 into the oil tank 62. When the interior part 4 reaches its original end position, the locking pin 66, when it overlaps with the bore section 76*a* arranged in the sprocket wheel 16, can fall into the bore section 76*a* and thus lock the camshaft adjuster again. In this case, the hydraulic oil situated in the bore section 76 can escape by way of the second bore section 76*b* and the groove 78.

The above-described control, in the case of which the locking pin of the camshaft adjuster itself exercises a valve function for the supply of hydraulic oil to the pressure spaces, is not limited to the embodiment described here. It can also be used in the case of camshaft adjusters which, in general, have a locking mechanism and to which a clear time sequence of unlocking and adjusting is to be assigned. This includes, for example, also the so-called axial camshaft adjusters, in the case of which a hydraulic piston arranged in the housing part (stator) of the camshaft adjuster is longitudinally displaceably guided and interacts by way of a spiral gearing with the part (rotor) of the camshaft adjuster non-rotatably connected with the camshaft. By means of the spiral gearing, the axial adjusting path of the piston is converted to an angle-of-rotation adjustment of the camshaft. Here also, a locking unit locking the piston can simultaneously take over the above-described valve function for the feeding of the hydraulic oil to the pressure space of the camshaft adjuster. The control for the unlocking and adjusting can naturally also be used for camshaft adjuster which are arranged on outlet camshafts of internal-combustion engines.

What is claimed is:

1. System for relative angle-of-rotation adjustment of a camshaft of an internal-combustion engine with respect to a driving wheel, having an adjusting unit which has an interior part non-rotatably connected with the camshaft, the adjusting unit having a cell wheel which encloses the interior part and which has several cells distributed along the circumference and bounded by webs, which cells are divided by webs or blades of the interior part angularly movably guided therein into two pressure spaces respectively, during whose hydraulic pressure admission or pressure relief, the camshaft can be rotated by way of the webs or blades between two end positions relative to the cell wheel and that a movable locking element interacts with at least one counterelement in the respective other one of the two components—cell wheel or interior part, that the locking element is arranged in a hydraulic line leading to a pressure space and, only in an unlocked position, opens up the hydraulic line to the pressure space, and that bores leading to the pressure spaces are arranged in the interior part, the openings of the bores in the locked end position of the adjusting unit being closed off by the webs of the cell wheel, characterized in that the locking element can be changed into a first unlocking position, in which the bore in the web controlled by the locking element as well as the bores in the interior part leading to the pressure spaces are still closed, and in that the locking element can be changed into a second unlocking position in which first the bore leading to the pressure space is opened up by the locking element and, after an initial adjusting path ($\alpha$) of the interior part, also the bores leading to the pressure spaces are opened up.

2. System according to claim 1, characterized in that the locking element is accommodated in a bore of a web and in that the bore is connected with the pressure space by way of a bore arranged in the web.

3. System, for adjusting an engine camshaft with respect to a driving wheel, comprising:

a first part movable together with an engine camshaft, a second part movable together with a driving wheel, a fluid pressure circuit operable to selectively change relative positions of the first and second parts, and a locking element operable to selectively mechanically lock the first and second parts in fixed relative positions, wherein said locking element is configured selectively to control fluid flow in the fluid pressure circuit, wherein locking element exhibits a stepped configuration which is operable to change fluid pressure applied to change the relative positions of the first and second parts as a function of positions of the locking pin, and wherein the locking element is movable between a first unlocking position blocking a part of the fluid pressure circuit leading to the pressure spaces and a second unlocking position opening said part of the fluid circuit leading to the pressure spaces.

4. System, for adjusting an engine camshaft with respect to a driving wheel, comprising:

a first part movable together with an engine camshaft, a second part movable together with a driving wheel, a fluid pressure circuit operable to selectively change relative positions of the first and second parts, and a locking element operable to selectively mechanically lock the first and second parts in fixed relative positions, wherein said locking element is configured selectively to control fluid flow in the fluid pressure circuit, wherein said first part is an interior part, wherein said second part is a wheel enclosing the interior parts, wherein one of said interior part and wheel have a plurality of cells and the other of said interior part and wheel have respective webs extending into respective ones of said cells and forming respective pressure spaces at opposite sides of the respective webs, or herein said fluid pressure circuit is operable to selectively change the fluid pressure in said pressure spaces, wherein said locking element is operable to selectively rotatably lock the interior part and wheel together, and wherein the locking element is movable between a first unlocking position blocking a part of the fluid pressure circuit leading to the pressure spaces and a second unlocking position opening said part of the fluid circuit leading to the pressure spaces.

* * * * *